US011649946B2

(12) United States Patent
Frison et al.

(10) Patent No.: US 11,649,946 B2
(45) Date of Patent: May 16, 2023

(54) LIGHTING DEVICE WITH AFOCAL PROJECTION OPTICS AND CORRESPONDING METHOD OF OPERATION

(71) Applicants: OSRAM GmbH, Munich (DE); CLAY PAKY S.p.A., Seriate (IT)

(72) Inventors: Renato Frison, Chions (IT); Alberto Alfier, Vedelago (IT); Aris Quadri, Seriate (IT)

(73) Assignee: CLAY PAKY S.P.A., Seriate (IT)

( * ) Notice: Subject to any disclaimer, the term of this patent is extended or adjusted under 35 U.S.C. 154(b) by 0 days.

(21) Appl. No.: 17/572,221

(22) Filed: Jan. 10, 2022

(65) Prior Publication Data

US 2022/0221128 A1 Jul. 14, 2022

(30) Foreign Application Priority Data

Jan. 11, 2021 (IT) ..... 102021000000377

(51) Int. Cl.

| | |
|---|---|
| ***F21V 5/04*** | (2006.01) |
| ***F21V 14/02*** | (2006.01) |
| ***F21V 14/06*** | (2006.01) |
| ***F21V 5/00*** | (2018.01) |
| *F21W 131/406* | (2006.01) |

(52) U.S. Cl.

CPC ..... *F21V 5/04* (2013.01); *F21V 5/008* (2013.01); *F21V 14/02* (2013.01); *F21V 14/06* (2013.01); *F21W 2131/406* (2013.01)

(58) Field of Classification Search

CPC .... F21V 14/06; F21V 5/008; F21W 2131/406

See application file for complete search history.

(56) References Cited

U.S. PATENT DOCUMENTS

| | | | | |
|---|---|---|---|---|
| 9,140,425 | B2 | 9/2015 | Kinzer et al. | |
| 2003/0076679 | A1* | 4/2003 | Oskotsky | G03F 7/70158 362/268 |
| 2004/0090667 | A1 | 5/2004 | Gartner et al. | |
| 2010/0321940 | A1* | 12/2010 | Zhong | F21V 14/04 362/268 |
| 2013/0155648 | A1* | 6/2013 | Morgenbrod | G02B 27/0944 600/249 |
| 2014/0131327 | A1* | 5/2014 | Nishitani | B23K 26/0734 219/121.63 |
| 2015/0260372 | A1 | 9/2015 | Quadri et al. | |
| 2016/0238217 | A1* | 8/2016 | Latteo | F21V 5/048 |
| 2016/0377256 | A1* | 12/2016 | Hansen | F21V 13/04 362/268 |
| 2017/0284637 | A1 | 10/2017 | Rehn | |

(Continued)

*Primary Examiner* — Oluseye Iwarere
*Assistant Examiner* — Michael Chiang
(74) *Attorney, Agent, or Firm* — Hauptman Ham, LLP

(57) ABSTRACT

A lighting device includes a light source configured to emit a light beam through an afocal projection optics along a propagation path of the light beam from a negative lens to a positive lens. The lighting device includes a further negative lens interposed and mobile along the propagation path of the light beam from the negative lens to the positive lens. The lighting device also includes an optical element interposed in the propagation path of the light beam between the negative lens and the further negative lens. The optical element includes a cylindrical lens, a prism or an axicon.

9 Claims, 5 Drawing Sheets

(56) References Cited

U.S. PATENT DOCUMENTS

| | | | | |
|---|---|---|---|---|
| 2018/0119924 | A1 | 5/2018 | Kinzer et al. | |
| 2019/0041039 | A1 | 2/2019 | Vilem et al. | |
| 2019/0187282 | A1 | 6/2019 | Muschaweck et al. | |
| 2019/0360665 | A1* | 11/2019 | Latteo ..... | G03B 21/14 |

* cited by examiner

LIGHTING DEVICE WITH AFOCAL PROJECTION OPTICS AND CORRESPONDING METHOD OF OPERATION

CROSS-REFERENCE TO RELATED APPLICATION

The application claims priority to Italian Patent Application No. 102021000000377 filed on Jan. 11, 2021, in the Italian Patent Office. The aforementioned application is hereby incorporated by reference in its entireties.

TECHNICAL FIELD

The description relates to lighting devices.

One or more embodiments may be employed, for example, in the show and entertainment sector.

TECHNOLOGICAL BACKGROUND

In sectors such as, for example, the show and entertainment sector (which is mentioned here by way of reference only), lighting devices are employed which are adapted to emit a light radiation of high intensity.

This may be the case, for example, for the products available on the market from the Applicant Clay Paky under the trade name of XTYLOS (see for instance claypaky.it).

The achievement of a smaller version of such a device does not only imply the mere reduction of the size and of the emission power, but also involves other issues (e.g., an insufficient mixing of the red colour with green and blue, residual speckles along the projected beam, the length of the mixing tube, constraints as regards design and maintenance flexibility, possible residual halos along the projected beam) which may appear or become more evident in comparison with the original topology.

A compact lighting device may employ an RGB light source, including laser diodes operating in the wavelength ranges of red (R), green (G) and blue (B), the radiations whereof are collimated and combined with each other by means of dichroic filters, in order to provide one single light beam.

The RGB radiation may be mixed by a double fly's eye integrator. The fly's eye lens structure is useful for solving the irradiance non-uniformity: it transforms the non-uniform irradiance profile at the exit pupil of the collimation optics into a homogenized far field profile.

In such a system it is possible to provide a secondary optical system (condenser optics) adapted to generate an image of said far field distribution on the so-called gobo area, which in turn is projected onto a projection area (typically a wall) by a projection lens.

Let us recall that by "gobo" we mean a disk or the like which is adapted to withstand the high operating temperatures of the projectors used in the shoe and entertainment sector and which, by operating essentially as a slide, enables the projection of images, texts, logos and abstract shapes.

On the whole, the above-mentioned components provide an optical system adapted to project slides positioned on the gobo plane.

On the other hand, especially for the applications envisaging very narrow beam angles (i.e., FWHM projection angles of about 1°), the overall length of said optical system is still quite long, which counters the need of implementing lighting devices having reduced size and weight.

OBJECT AND SUMMARY

One or more embodiments aim at tackling said further issues in order to obtain a compact lighting device, e.g., as regards the projection system.

According to one or more embodiments, said object may be achieved thanks to a lighting device having the features set forth in the claims that follow.

One or more embodiments may refer to a corresponding method of operation.

The claims are an integral part of the technical teachings provided herein with reference to the embodiments.

One or more embodiments may comprise an afocal projection system which may be used in combination with cylindrical lenses, glass pyramid prisms and/or so-called axicons in order to create projection effects in a narrow light beam spot projector (as it is desired, for example, in show and entertainment applications).

One or more embodiments may achieve a particularly compact system by omitting a condenser unit and a gobo surface.

It will moreover be appreciated that the embodiments are adapted to be applied also in contexts other than outlined in the foregoing, i.e., also in devices different from the device described in the foregoing.

BRIEF DESCRIPTION OF THE FIGURES

One or more embodiments will now be described, by way of non-limiting example only, with reference to the annexed Figures, wherein.

Figure 1:
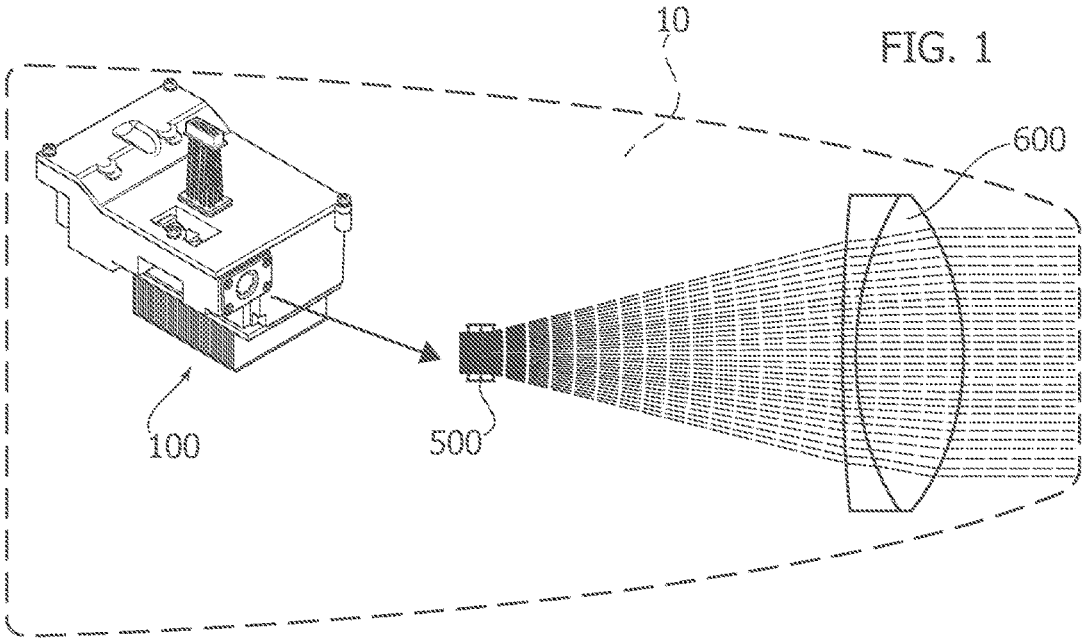
FIG. 1 is an overall view of a lighting device.

It will be appreciated that, for simplicity and clarity of illustration, the various Figures may not be drawn to the same scale; the same may be true for different parts in a single figure. Moreover, unless the context indicates otherwise, similar parts or elements are denoted with the same references in the various figures; for the sake of brevity, the repetition of the description thereof for each figure will be omitted.

DETAILED DESCRIPTION OF EXEMPLARY EMBODIMENTS

In the following description, various specific details are given to provide a thorough understanding of various exemplary embodiments according to the specification. The embodiments may be practiced without one or several specific details, or with other methods, components, materials, etc. In other instances, well-known structures, materials or operations are not shown or described in detail in order to avoid obscuring various aspects of the embodiments.

Reference throughout this specification to "one embodiment" or "an embodiment" means that a particular feature, structure or characteristic described in connection with the embodiment is included in at least one embodiment. Thus, the possible appearances of the phrases "in one embodiment" or "in an embodiment" in various places throughout this specification are not necessarily all referring exactly to the same embodiment. Furthermore, particular features, structures, or characteristics may be combined in any suitable manner in one or more embodiments.

The headings provided herein are for convenience only, and therefore do not interpret the extent of protection or scope of the embodiments.

As stated in the foregoing, the presently illustrated exemplary embodiments may be adapted to be employed in contexts other than outlined in the foregoing.

In this respect, and in order to provide an introduction to the following detailed description, it may be useful to recall some basic concepts of the prior art, as exemplified in the patent literature. This will enable omitting a more detailed description herein.

Zoom optics (such as, e.g., combinations of positive and negative lenses, mobile lenses etc.) is a technical field which provides numerous solutions, based on cylindrical lenses and afocal lens systems.

For example, documents such as U.S. Pat. No. 9,140,425 B2 and US 2018/119924 A1 describe an asymmetrical illumination effect achieved by cylindrical components, with the aim of producing a diffuse and widespread illumination for Cyclorama (the background surrounding the performance space) applications.

Document US 2017/284637 A1 describes an afocal system which constitutes an intermediate optical component between an illumination unit and a freeform reflector, in order to obtain a rectangular illuminance distribution on a wall.

Document US 2019/187282 A1 describes the use of both cylindrical lenses and prisms in order to steer and expand a narrow laser beam, which is employed to scan and measure object distances, whereas document US 2004/090667 A1 describes the use of a cylindrical lens to change the shape and orientation of a light beam, in order to automatically detect the best focusing plane in a microscope.

Both said documents concern the measurement of a distance from a lens (either a projection lens or a microscope lens).

The goal pursued in one or more embodiments (for example projecting, deforming and splitting images of different shapes, such as ovals and stars, etc., on a wall) leads to adopting different solutions, e.g., as regards the splitting of the light beam by means of a prism.

For example, unlike what is disclosed in Document US 2019/187282 A1, it is possible to use a prism with only one face (or diffraction grating) to steer the light beam according to the light wavelength (according to the well-known dispersion law from optics).

To a given extent, one or more embodiments envisage "exacerbating" the prism splitting effect by separating the light into multiple sub-beams, thanks to a—for instance six-faceted—pyramid which is not excessively steep (i.e., the height of the pyramid between the vertex and the base is small) in order to avoid colour separation, which would result in unpleasant projection colour artifacts.

One or more embodiments, therefore, avoid separating the light beam according to wavelengths, but rather aim at separating it angularly into smaller light beams, each virtually comprising all light wavelengths.

As regards the use of a cylindrical lens, and referring again to Document US 2019/187282 A1, it may be observed that the goal of said prior document consists in outputting a linear (and not punctiform) laser signal, in order to scan a distant object, by using two cylindrical lenses. Moreover, the related measuring units make use of two cylindrical lenses and are separated from the cameras recording the images.

On the contrary, one or more embodiments:

aim at projecting images and not at detecting distances or scanning objects, use only one cylindrical lens (instead of two), envisage inserting the beam enlarging optics (i.e., the cylindrical lens) into an already existing projection lens (the afocal zoom lens), dynamically position the circle of least confusion on different planes beyond the projection optics, thanks to the intrinsic zoom capabilities of the projection optics itself.

Unlike Document US 2004/090667 A1, one or more embodiments:

aim at projecting images, and not at detecting the best focusing planes;

dynamically set a circle of least confusion on different planes beyond the projection optics (thanks to the intrinsic zoom capabilities of the projection optics itself), the astigmatic beam shape emerging from the microscope objective described in US 2004/090667 A1 being indeed a static light beam;

are different from the cylindrical lens of US 2004/090667 A1, which is not positioned along the optical path, so that the movement of the optical assemblies does not affect the shape of the emerging beam;

envisage positioning the cylindrical lens on the optical axis, thereby directly modifying the projected beam, while Document US 2004/090667 A1 teaches the use of the cylindrical lens off-axis, in order to generate (together with another reference beam) two separate light spots on the image space.

From this general overview it may be inferred, moreover, that unlike a standard projecting lens, which conjugates a real object plane (where a gobo may be placed) to a real image plane (usually a wall), an afocal projection lens has infinite effective focal length. Therefore, it conjugates a virtual object plane (positioned at infinity) to a virtual image plane (again positioned at infinity or equivalent, very far from the objective exit surface). In the case of a small-sized optics system (having, e.g., a length of approximately 10 cm), "very far" practically means greater than 5 m.

In order to obtain afocal projection lenses it is possible to resort to the Galilean telescope design, which consists of a positive power lens (i.e. a convergent lens, the objective) and a negative power lens (i.e. a divergent lens, the eyepiece), wherein the focal points of both lenses coincide: this solution greatly reduces the overall telescope length compared to a classical Keplerian design, wherein both the objective lens and the eyepiece lens are positive; this translates into an advantage, because it further reduces the overall length of the system.

Moreover, an afocal projection lens does not necessarily imply that the projection optics has a fixed focal length. Indeed, it may be envisaged for the projection afocal lens to have a variable focal length, so as to provide zoom capabilities (and thereby enabling, for instance, to open up to a larger extent a narrow beam angle, from FWHM=1° to FWHM=7°). This feature is particularly appreciated in the presently considered type of devices, in order to create light effects.

An immediate advantage which can be obtained by introducing an afocal projection lens is the overall system compactness.

However, this brings about a possible disadvantage deriving from the impossibility of projecting all kinds of images on a wall: actually, because the object plane is virtual (or at infinity), it becomes practically impossible to place a gobo in all possible positions along the system optical path.

This function (image projection) may be partially recovered by resorting to a few presently exemplified solutions, such as:

introducing, e.g., by means of an effect wheel, a cylindrical lens placed at the afocal projection lens optics (but distinct therefrom) which is adapted to "elongate" or "squeeze" the light beam along the axis direction or along a direction orthogonal (perpendicular) to the optical axis;

introducing, e.g., again by means of an effect wheel, a transparent (e.g., glass) multi-faceted (e.g., six-faceted) pyramid prism, thereby splitting the light beam into a plurality of different smaller sub-beams;

introducing, e.g., again by means of an effect wheel, an axicon (a special kind of lens having a conical surface), thereby splitting the light beam into a virtually infinite number of smaller sub-beams which resolve into a ring.

The first solution (cylindrical lens) enables for example to "elongate" or "squeeze" focused and unfocused hexagonal patterns (i.e., the virtual gobo plane obtained by a fly's eye lens integrator) into elongated hexagonal or oval shapes projected on a wall, wherein the orientation of the elongated pattern may be controlled by means of the zoom lens configuration or by rotating the cylindrical lens orthogonally to the optical axis.

The second solution (faceted pyramid prism) allows projecting a plurality of separated light beams (at various distances from the optical axis, by modifying the magnification factor of the afocal optics, i.e., by zooming), with the result of producing, for example:

separated and partially illuminated hexagonal shapes projected on a wall, or partially overlapping out-of-focus hexagonal shapes, in order to project star-like shapes.

The third solution (axicon) enables projecting "infinite" separated light beam (at various distances from the optical axis, by changing the magnification factor of the afocal optics, i.e., by zooming), with the result of producing a ring-shaped distribution projected on a wall and optionally adapted to finally converge into a spot.

In FIG. 1, reference 10 denotes on the whole a lighting device 10 including a light radiation source 100.

The lighting device 10 may have a mobile head and may be adapted to be employed in the show and entertainment sector.

Device 10 and source 100 are shown deliberately schematically, in order to highlight the fact that one or more embodiments may be widely "transparent" as regards the specific features of device 10 and source 100.

For example, source 100 may be of the sort including laser diodes operating in the red (R), green (G) and blue (B) wavelengths, the radiations whereof are collimated and combined with one another, for instance by means of dichroic filters, so as to provide a single RGB light beam, which may be subjected to mixing in a mixing unit comprising fly's eye optics.

In the present case, source 100 includes a (negative) output lens 500, adapted to act on the light beam output from source 100.

As it is well known, by negative lens we mean a divergent lens, adapted to reduce the convergence of the rays coming from an impinging collimated light source.

The fact that, because lens 500 is included in source 100, the output beam is a divergent beam makes source 100 intrinsically safe from a photobiological point of view, making the maintenance 10 thereof easier.

FIG. 1 shows a solution which may be adopted in order to adjustably conform said light beam, e.g., in an angular aperture range between 1° (substantially collimated beam) and 5° (slightly divergent beam).

For example, as exemplified in FIG. 1, it is possible to move by known means a frontal (positive) lens 600 of the afocal system, i.e., the lens arranged more outwardly than (negative) lens 500. By so doing, it is possible to change the overall focal length of the projection optical system (consisting of lenses 500 and 600) from infinity (afocal) to a finite value, and this causes a change in convergence (angular distribution) of the collimated light beam intercepted by lens 500.

Figure 2:
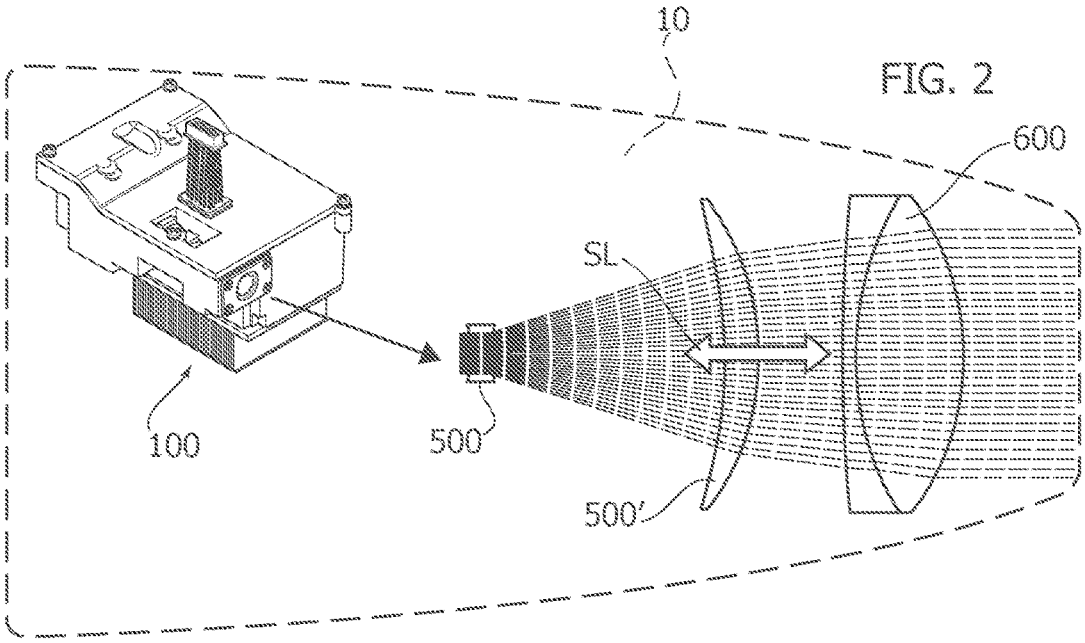
FIG. 2 is an overall view of a lighting device according to embodiments of the present specification.

FIG. 2 shows another solution which may be adopted in order to adjustably collimate the light beam output from source 100.

As exemplified in FIG. 2, it is possible to move, again by means known in themselves (e.g., with a motor, which is schematically indicated by the double arrow ML in FIG. 2), an intermediate (negative) lens 500' of the afocal system, while keeping the (negative) lens 500 and the (positive) frontal lens 600 fixed.

Both solutions in FIGS. 1 and 2 enable shaping the beam by afocal zooming.

In comparison with the solution of FIG. 1, the solution of FIG. 2 may offer various advantages, such as for example a sharper projected image and a better filled light beam volume, together with the possibility of obtaining a more lightweight system.

In the solution of FIG. 2, the beam shaping action from narrow to wide angle is controlled by lens 500', which moves internally between lenses 500 and 600, the movement thereof being "hidden" to the user because the first negative lens 500 and the outer positive lens 600 (for example, an achromatic doublet) stay fixed.

In the solution of FIG. 2, the use of a simple negative lens 500 (instead of a negative doublet, as exemplified in FIG. 1) may reduce projection artifacts, such as halos.

Figure 3:
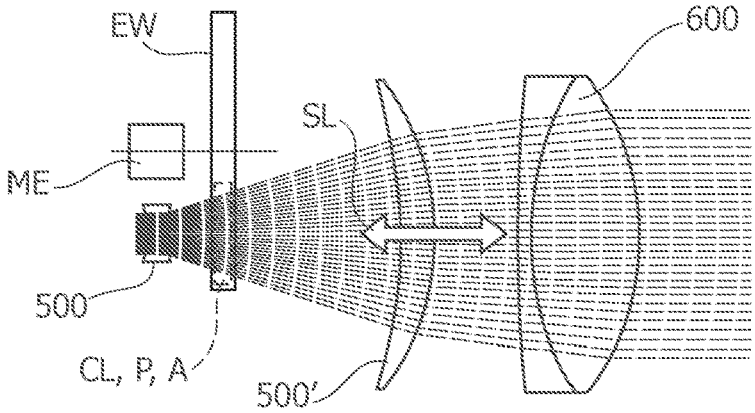
FIG. 3 is an overall view showing further possible features of a device according to embodiments of the present specification.

As shown in FIG. 3 (wherein, as in the following figures, device 10 and source 100 are no longer shown for simplicity of illustration), in order to create additional projection effects an effect wheel EW may be positioned along the light beam path.

An effect wheel includes (in a way known in itself to the experts in the field) a set of filters, gobo images, frost filters, glass prisms and lenses, which are fixed or may be adapted to spin around their mechanical axis, for example driven by a motor ME.

In order to create an effect, an aperture of the wheel is chosen (e.g., a given colour filter or the like) and aligned so that its axis is coincident with the projection optical axis.

In one or more embodiments, the effect wheel EW may be inserted between lens 500 and lens 500', so as to interpose, in the light radiation path between lens 500 and lens 500', an optical component which may be selected for example from a cylindrical lens CL, a prism P and an axicon A.

Figure 4A:
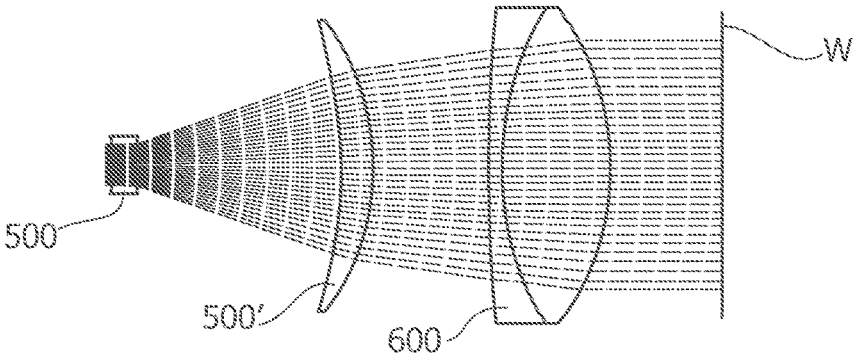
FIGS. 4A and 4B show possible operating criteria of a device according to embodiments of the present specification.
Figure 4B:
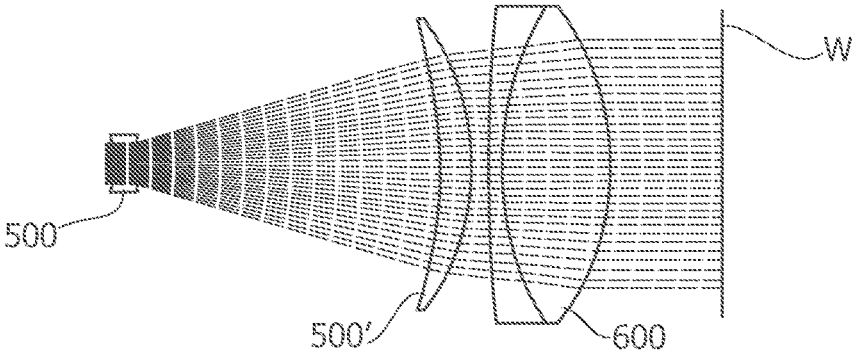

As shown in FIGS. 4A and 4B, the "intermediate" lens 500' may move (e.g., under the action of motor SL) between:

a first extreme position, retracted towards lens 500, for a wide beam projection—see FIG. 4A, and a second extreme position, advanced towards lens 600, for a narrow beam projection—see FIG. 4B.

For example:

in the wide beam mode it is possible to project in the far field a defocused image with the hexagonal pattern of a fly's eye lenticular (FWHM approx. 7°);

in the narrow beam mode it is possible to project in the far field a sharp (not defocused) image of said hexagonal pattern (FWHM approx. 1,1°).

By inserting a cylindrical lens CL (present on an effect wheel such as EW) along the optical axis of light propagation, when lens 500' is moved from the position of FIG. 4A to the position of FIG. 4B it is possible to switch:

from a light beam which is "elongated" or "squeezed" in a first direction, when lens 500' is close to one of the extreme positions of FIGS. 4A and 4B, to a light beam which is "elongated" or "squeezed" in a second direction, orthogonal to the first direction, when lens 500' is close to the other of the extreme positions of FIGS. 4A and 4B.

on the other hand, when lens 500' is in an intermediate position between said two extreme positions, the light beam projected has a substantially circular profile.

In this regard it will be appreciated that, for ease of comprehension, the propagation of the rays coming from the source is here shown as graphically circumscribed to the projection lens only, being it understood that the projection plane, e.g., a wall W, is generally located at a certain distance (greater than 5 m, for example) from the source.

The previously described effect may be explained by considering the combination of a spherical lens (such as for example lens 500, which is a negative bi-concave lens) and a cylindrical lens.

A cylindrical lens produces an astigmatic focus, which contains a first focal plane corresponding to the focus of the horizontal principal meridian, and a second focal plane corresponding to the focus of the vertical principal meridian. Between these focal planes, the astigmatic focus forms a circular region known as "circle of least confusion".

Figure 5:
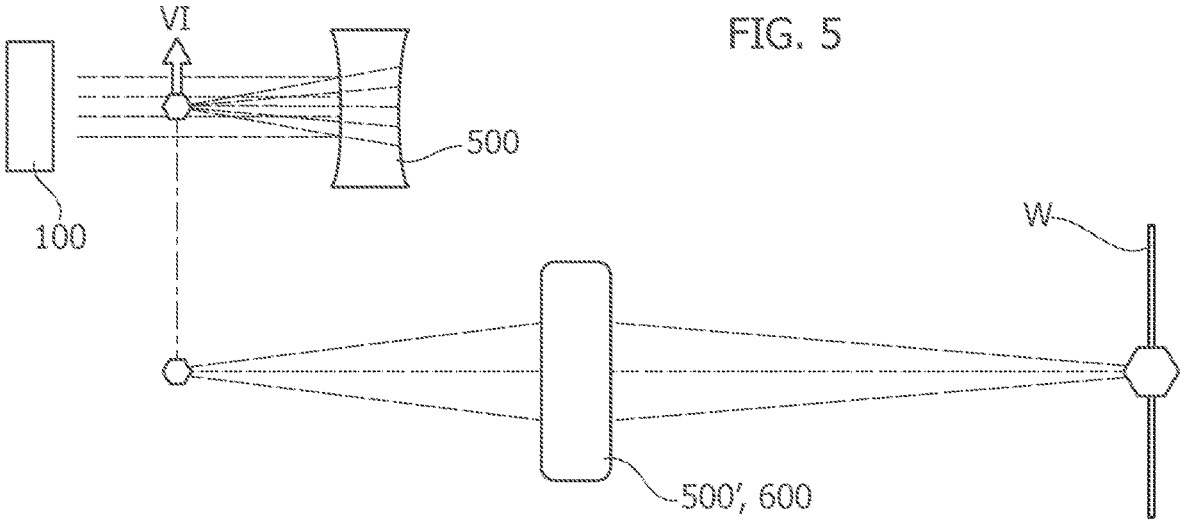
FIG. 5 and FIGS. 6A and 6B show operating principles to be employed in a device according to embodiments of the present specification.

As shown by way of example in FIG. 5, if the beam impinging on lens 500 is collimated, the (negative) lens 500 creates a virtual image VI (for example the hexagon of a fly's eye lenticular, which may be assumed as being infinity conjugated to source 100) in the focal point of lens 500, which is located behind lens 500 itself.

The remaining components of the projection optics (i.e., lens 500' and lens 600) conjugate the virtual image to the position of wall W, where a real image hexagon is projected.

When a cylindrical lens CL (which may be contained in the colour wheel EW, but which is presently considered, more generally, as a separate element) is inserted along the beam path, two virtual images are created: one in the horizontal principal meridian (HPM) and the other in the vertical principal meridian (VPM), which is orthogonal to the horizontal principal meridian with respect to the optical axis.

Figure 6A:
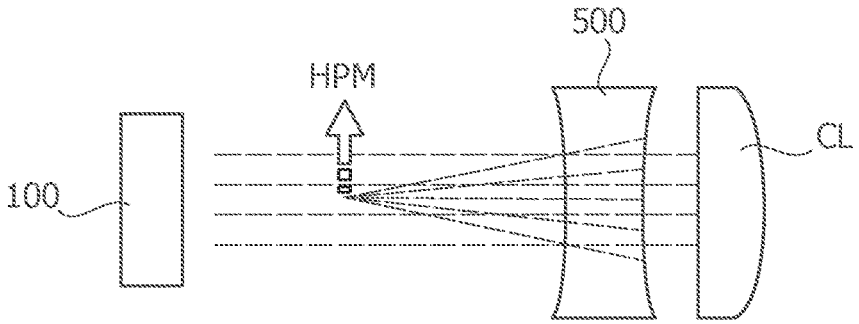
Figure 6B:
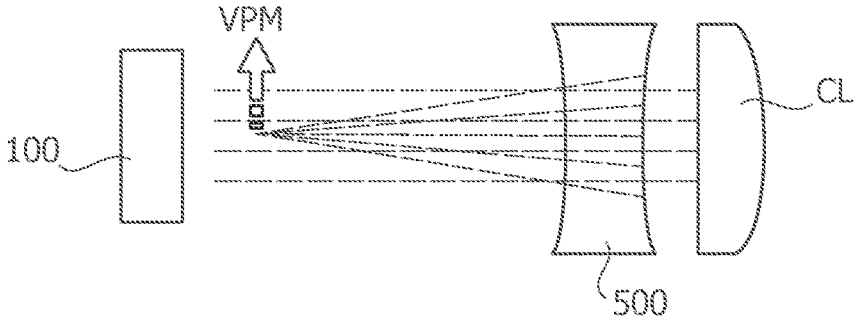

As shown in FIGS. 6A and 6B, thanks to the presence of cylindrical lens CL two virtual images are created in two different positions along the optical axis, both virtual images having a different magnification along two orthogonal directions.

For example:

a first hexagonal virtual image will be magnified more only along one direction (which may be defined as the y axis, for example) in a plane HPM perpendicular to the optical axis (z axis)—see FIG. 6A; and a second hexagonal virtual image will be magnified more only along one direction (which may be defined as the x axis, for example) in a plan VPM perpendicular to the optical axis (z axis)—see FIG. 6B.

Figure 7:
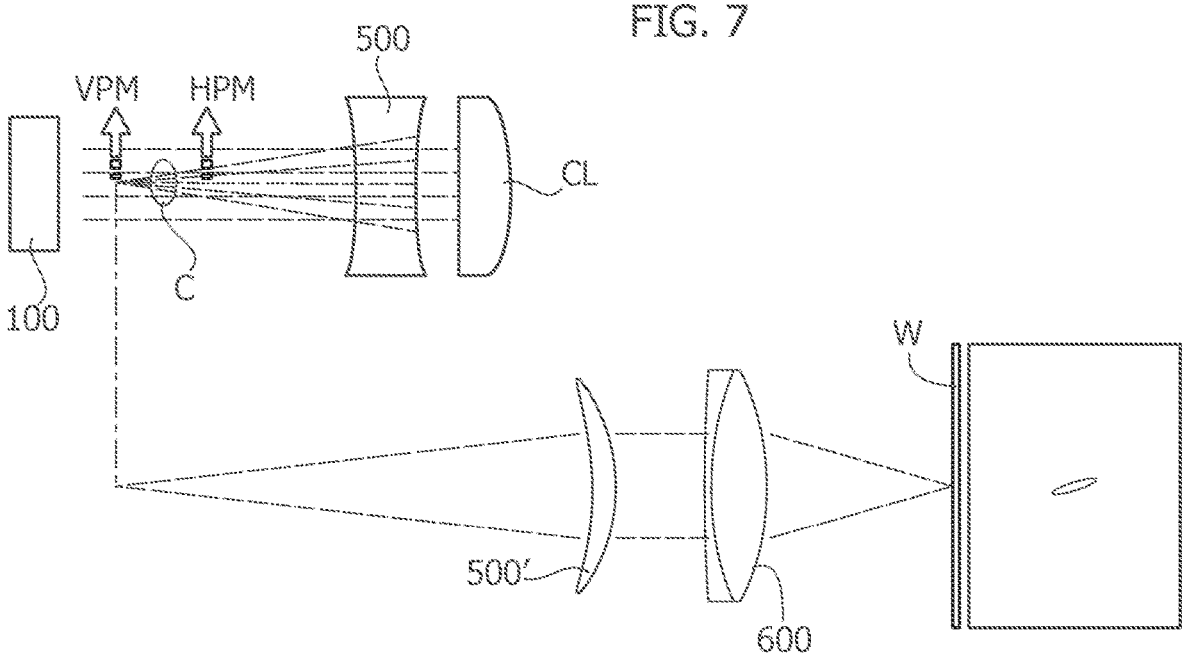
FIGS. 7, 8 and 9 show possible operating conditions of a device according to embodiments of the present specification.

When, as exemplified in FIG. 7, lens 500' of the projection optics is moved to conjugate to wall W the VPM virtual image in wide beam mode, a shape (hexagon) elongated in one (first) direction will be projected onto wall W.

Figure 8:
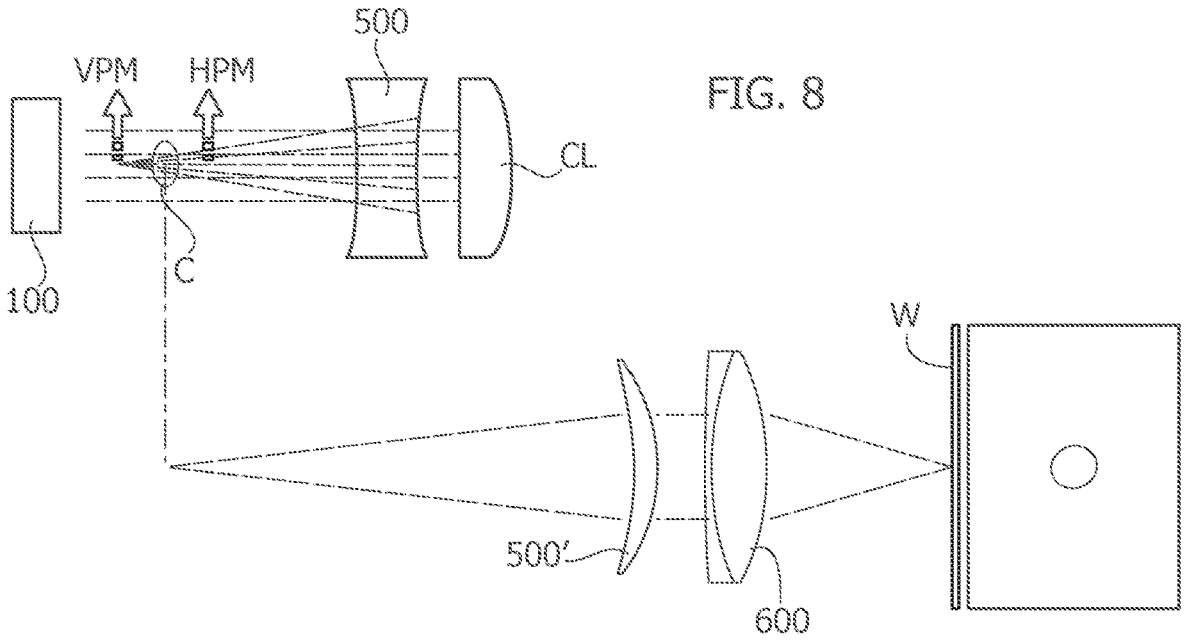

When, as exemplified in FIG. 8, lens 500' of the projection optics is moved to conjugate to wall W the circle of least confusion C (more or less halfway between the wide beam mode and the narrow beam mode), an at least approximately circular (e.g., not hexagonal) shape will be projected onto wall W.

Figure 9:
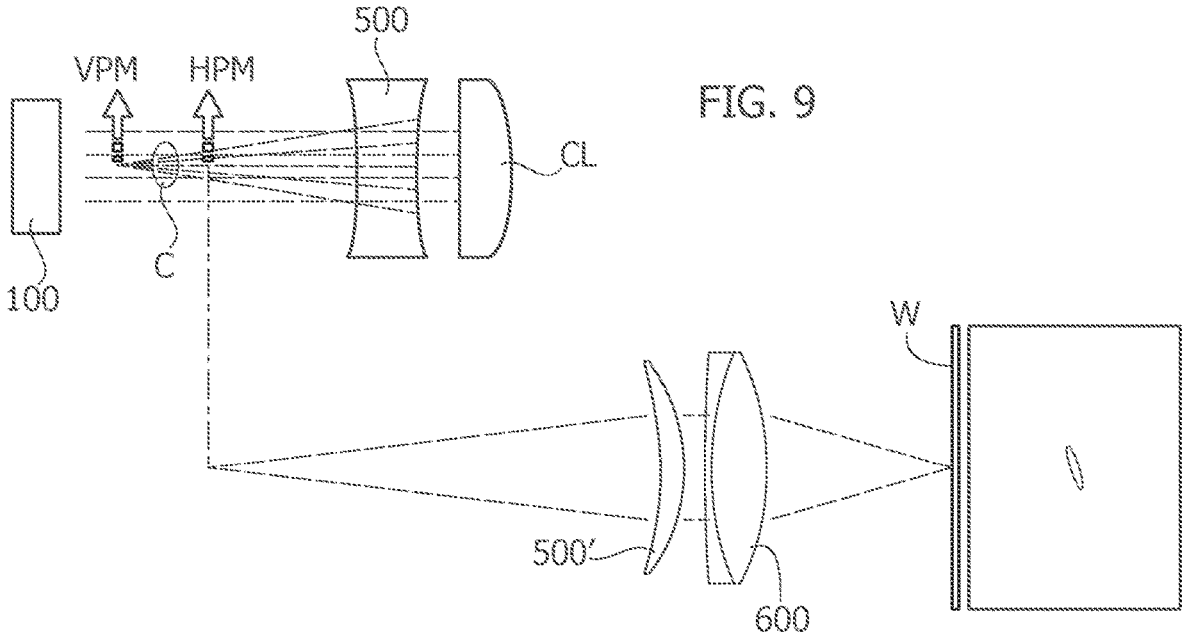

Finally, when, as exemplified in FIG. 9, lens 500' of the projection optics is moved to conjugate to wall W the HPM virtual image in narrow beam mode, a shape (hexagon) elongated in a (second) direction, orthogonal to the first direction as seen in FIG. 7, will be projected onto wall W.

Figure 10:
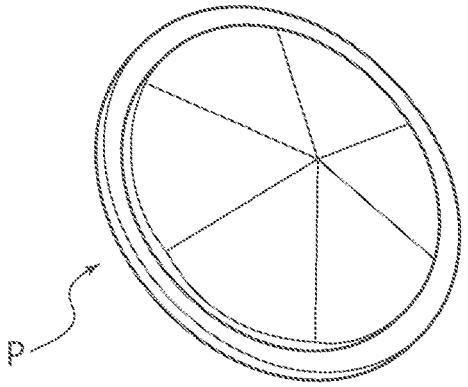
FIG. 10 is a perspective view of an optical component adapted to be employed in a device according to embodiments of the present specification.

In addition, or as an alternative, an interesting effect may be created by using a transparent (e.g., glass) prism optical component, such as a multifaceted, e.g., six-faceted, pyramid, as shown in FIG. 10.

As in the case of the cylindrical lens CL, prism P may be included in the effect wheel EW, but it is shown here, more generally, as a separate element.

As stated in the foregoing, prism P may advantageously have a not excessively steep pyramid shape (i.e., the height of the pyramid between the vertex and the base thereof is short), which limits the appearance of projected colour artifacts.

As exemplified in FIG. 11 (wherein, unless the context indicates otherwise, parts or elements similar to parts or elements discussed with reference to the previous figures are denoted by the same references, without repeating the description thereof for the sake of brevity), prism P may be placed between lens 500 and lens 500'.

Figure 11:
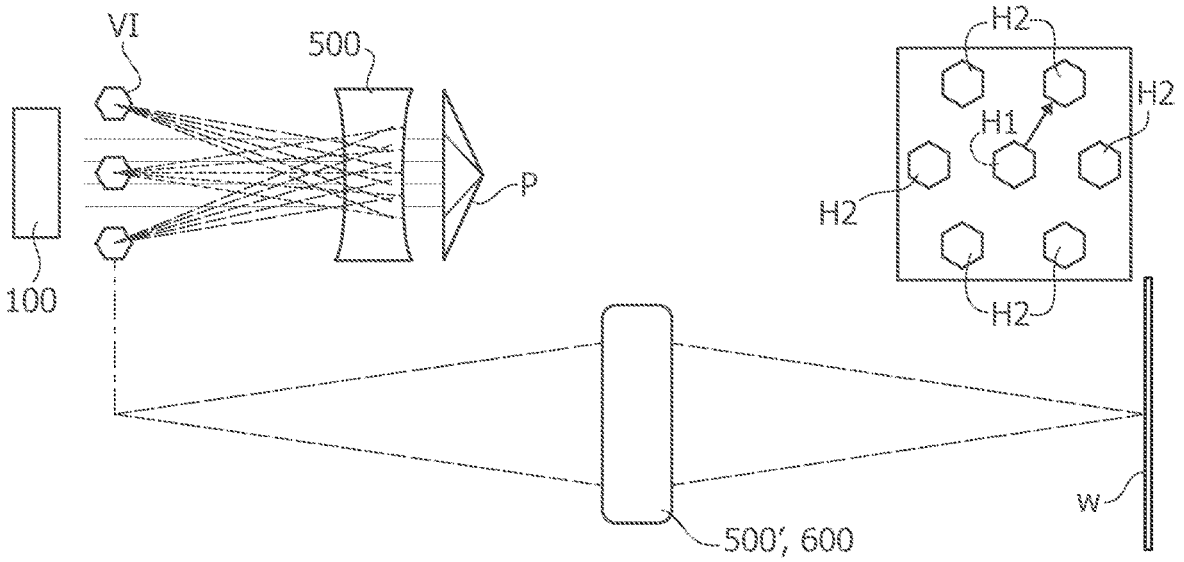
FIG. 11 shows possible operating conditions of a device according to embodiments of the present specification which employ a component as shown in FIG. 10.

As exemplified in FIG. 11, prism P may be oriented with the pyramid faces towards lens 500'.

Thanks to prism P, the single virtual image VI (e.g., a hexagon) may be split into six different "partial hexagon" images projected on wall W.

This may take place separately (in the narrow beam mode illustrated in FIG. 11) or in a mutual overlapping (in the wide beam mode), therefore obtaining a star-shaped projected image.

Prism P splits the single (e.g., hexagonal) virtual image H1 created by lens 500 for example into six separated hexagonal virtual images H2.

The components of the projection lens optics (lens 500' and lens 600) conjugate the virtual hexagon images to the position of wall W, where a real image hexagon is projected.

Because of the splitting of the rays due to prism P, only a part (e.g., one sixth in the case of a six-faceted prism) of the rays coming from the light source 100 (a laser array, for example) contributes to the creation of the single projected image (hexagon).

The projected images (e.g., H2) may therefore appear partially vignetted and defocused in the outer region thereof.

Also, in the embodiments employing a prism P it is possible to move lens 500' between a wide beam mode and a narrow beam mode through intermediate positions, as exemplified in FIGS. 7 to 9 in the case of embodiments which employ a cylindrical lens CL.

Without reproducing, for the sake of brevity, the corresponding figures, it may be observed that:

by moving lens 500' towards lens 500, in order to obtain a wider beam angle, without prism P, the single image (hexagon H1) is defocused. With prism P inserted along the optical path, also the split images (hexagons H2) are defocused;

by further moving lens 500' towards lens 500, without prism P, the single image is even more defocused. With prism P inserted, the split images are further defocused, until they touch each other creating a sort of "daisy" image;

when lens 500' is further moved towards lens 500 until reaching the extreme wide-angle position, without prism P, the single image is completely defocused. With prism P inserted, also the split images are completely defocused, and they overlap each other thus creating a star-shaped compact image (the star having a number of points corresponding to the number of facets, e.g., six, of prism P).

Figure 12:
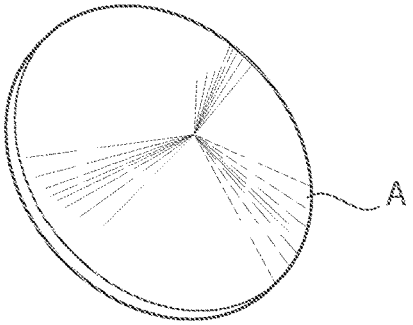
FIG. 12 is a perspective view of an optical component adapted to be employed in a device according to embodiments of the present specification.

In addition, or as an alternative, equally interesting effects may be achieved by using a transparent (e.g., glass) optical element A of the type currently denoted as "axicon", as shown in FIG. 12.

An axicon is a lens comprising any optical material and having a conical surface. As far as the present case is concerned, it may be considered as a "degeneration" of prism P into a pyramid with an infinite number of facets, and therefore a cone.

As in the case of the cylindrical lens CL and of the prism P, the axicon A may be included in the effect wheel EW, but it is here more generally considered as a separate component.

As in the case of prism P, axicon A may have a not excessively steep conical shape (i.e., the height of the cone from the vertex to the base is short), which limits the appearance of colour artifacts in the projected image.

As exemplified in FIG. 13 (wherein, unless the context dictates otherwise, parts or elements similar to the parts or elements discussed with reference to the previous figures are denoted by the same references, without repeating the description thereof for the sake of brevity), axicon A may be placed between lens 500 and lens 500'.

Figure 13:
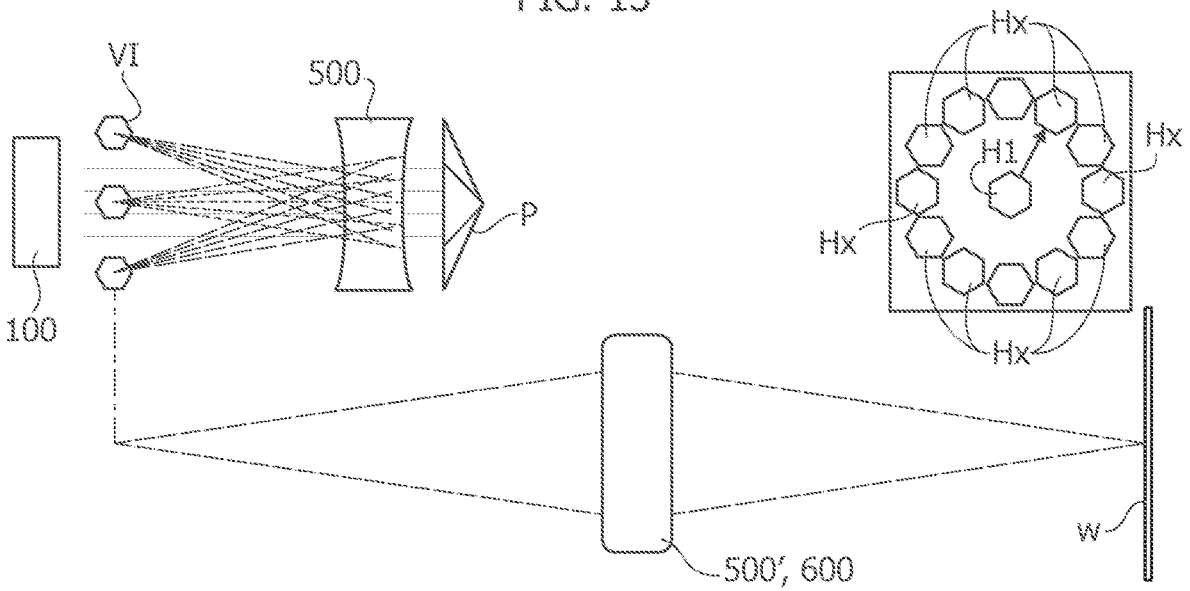
FIG. 13 shows possible operating conditions of a device according to embodiments of the present specification which employ a component as shown in FIG. 12.

As exemplified in FIG. 13, axicon A may be oriented with the conical surface facing towards lens 500'.

Axicon A splits the single (e.g., hexagon) virtual image created by lens 500 (hexagon H1 in FIG. 13) into a virtual infinity of separate virtual images (hexagons HX in FIG. 13) which combine together into a ring-shaped distribution.

The components of the projection optics (lens 500' and lens 600) conjugate the virtual hexagon images to the position of wall W where a real image hexagon is projected.

Thanks to the splitting of the rays due to axicon A, the rays coming from the light source 100 contribute to the creation of the projected ring (indeed an overlapping of an infinite number of images such as hexagons).

Also, in the embodiments envisaging the use of an axicon A it is possible to move lens 500' between a wide beam mode and a narrow beam mode, through intermediate positions, as exemplified in FIGS. 7 to 9 for the embodiments employing a cylindrical lens CL.

Without showing the corresponding Figures for the sake of brevity, it may be observed that:

by moving lens 500' towards lens 500, in order to obtain a wider beam angle, without axicon A the single image (hexagon) will be defocused. With axicon A inserted along the optical path, the split images are defocused, as well as the ring-shaped distribution thereof;

by further moving lens 500' towards lens 500, without axicon A, the single image (hexagon) is more defocused. When axicon A is inserted, the ring-shaped distribution converges to a circular spot distribution;

by moving lens 500' even further towards lens 500, until the extreme wide-angle position is reached, without axicon A, the single image (hexagon) is completely defocused. When axicon A is inserted, the light distribution converges to a hot spot shaped distribution.

One or more embodiments may therefore envisage removing the condenser optics and the gobo plane and introducing an optical component such as an afocal projection lens, which helps reducing the length of a narrow beam projection optics.

In this context, by introducing a cylindrical lens into the optical path, it is possible to partially recover various image projection effects, e.g., with the possibility of:

"squeezing" or "elongating" the illuminance distribution along mutually orthogonal direction with reference to the optical axis (FIGS. 7 and 9, for example);

creating a round shaped illuminance projected profile for example out of a hexagonal distribution, thereby emulating a circular gobo aperture (FIG. 8, for example);

twisting the beam squeezed (oval) shape with respect to the optical axis: the light beam will result in a spot elongated in one direction, the x-direction (FIG. 7, for example) over a projection plane closer to the lens, and elongated in the orthogonal direction, the y-direction (FIG. 9, for example) over a projection plane further away from the lens, thereby providing a twisted appearance of the light beam;

controlling, by zooming the lens, the orientation of the elongated beam over a projection plane (wall W, for example) and the position of the elongated shape along the beam.

By introducing a pyramid-shaped faceted glass prism (for example P) into the optical path it is possible to recover various (further) image projection effects, for example with the possibility of:

splitting the main light beam into smaller secondary light beams (sub-beams);

controlling the sizes of such secondary beams by zooming the lens, e.g., by defocusing a hexagonal lenticular shape;

partially overlapping said secondary beams, by further zooming the lens;

totally overlapping the secondary beams, thereby creating a star-shaped image in the extreme (wide beam) zoom configuration.

By introducing an axicon (e.g., A) into the optical path it is moreover possible to recover further image projection effects, for example with the possibility of:

splitting the main light beam into an infinite number of secondary beams, which resolve into a circular ring-shaped distribution;

creating a round shaped illuminance profile by zooming the lens;

creating a hot spot shaped illuminance projected profile in the extreme (wide beam) zoom configuration.

Arranging on an effect wheel such as EW at least two optical elements (and optionally all three optical elements) selected from cylindrical lens CL, prism P and/or axicon A enables obtaining the previously described effects selectively, e.g., according to the envisaged application and/or according to the choices of the lighting director.

A lighting device (e.g., 10) as illustrated herein may comprise a light source (e.g., 100) configured to emit a light beam through an afocal projection optics (e.g., 500, 500', 600) along a propagation path of the light beam from a negative lens (e.g., 500) to a positive lens (e.g., 600), wherein the lighting device comprises:

a further negative lens (e.g., 500') interposed and mobile (for example by means of motorization SL) along the propagation path of the light beam from the negative lens to the positive lens, and an optical element interposed in the propagation path of the light beam between the negative lens and the further negative lens, the optical element comprising an optical element selected from a cylindrical lens (e.g., CL), a prism (e.g., P) and an axicon (e.g., A).

In other words, either the device may be stably equipped with (only) one of such optical elements (CL, P or A), or it may be configured so as to enable replacing one optical element with another according to the user's needs or tastes.

For example, a lighting device as illustrated herein may comprise a mobile support member (e.g., EW) carrying at least two different optical elements selected from a cylindrical lens (CL), a prism (P) and an axicon (A), the mobile support member being configured (e.g., ME) to selectively interpose in the propagation path of the light beam, between the negative lens and the further negative lens, an optical element selected from said at least two different optical elements, so that it may switch for example:

from a cylindrical lens to a prism or to an axicon,
from a prism to a cylindrical lens or to an axicon,
from an axicon to a cylindrical lens or to a prism.

In a lighting device as illustrated herein, the mobile support member may comprise a motorized (e.g., ME) effect wheel (EW).

The presence of the optical element (CL, P or A) enables obtaining imaging optical effects without a gobo and by means of an afocal projection optics.

In a lighting device as illustrated herein, the negative lens (e.g., 500) may comprise a simple negative lens.

In a lighting device as illustrated herein, the positive lens (e.g., 600) may comprise an achromatic doublet.

In a lighting device as illustrated herein, when the optical element interposed in the propagation path of the light beam between the negative lens and the further negative lens comprises a prism, said prism may include a pyramidal prism (e.g., P).

In a lighting device as illustrated herein, the pyramidal prism may be interposed in the propagation path of the light beam between the negative lens and the further negative lens, with the tapered side thereof facing towards the positive lens (i.e., with the pyramid tapered side facing towards the further negative lens 500' and the base of the prism facing towards the negative lens 500).

In a lighting device as illustrated herein, when the optical element interposed in the propagation path of the light beam between the negative lens and the further negative lens comprises an axicon, the axicon may be interposed in the propagation path of the light beam between the negative lens and the further negative lens, with the tapered side thereof facing towards the positive lens (i.e., with the cone tapered side facing towards the further negative lens 500' and the cone base facing towards the negative lens 500).

A method of operating a lighting device as illustrated herein may comprise moving the further negative lens (500', e.g., by means of motorization SL) along the propagation path of the light beam, bringing it closer to the negative lens and away from the positive lens, or moving it away from the negative lens and bringing it closer to the positive lens.

A method as illustrated herein may comprise selectively changing the optical element (e.g., CL, P, A) interposed in the propagation path of the light beam, thereby enabling switching, for example:

from a cylindrical lens to a prism or to an axicon,
from a prism to a cylindrical lens or to an axicon,
from an axicon to a cylindrical lens or to a prism.

Without prejudice to the basic principles, the implementation details and the embodiments may vary, even appreciably, with respect to what has been described herein by way of non-limiting example only, without departing from the extent of protection.

The extent of protection is defined by the annexed claims.

LIST OF REFERENCE SIGNS

Lighting device 10
Light source 100
Fixed negative lens 500
Mobile negative lens 500'
Lens motorization ML
Fixed positive lens 600
Effect wheel EW
Effect wheel motorization ME
Projection surface (wall) W
Cylindrical lens CL
Virtual image VPM, HPM
Circle of least confusion C
Prism P
Single image H1
Split images H2
Axicon A
Virtual images VI
Split images HX

The invention claimed is:

1. A lighting device, comprising:

a light source configured to emit a light beam through an afocal projection optics along a propagation path of the light beam from a negative lens to a positive lens;

a further negative lens interposed and mobile along the propagation path of the light beam from the negative lens to the positive lens; and a mobile support member carrying at least two different optical elements selected from a cylindrical lens, a prism and an axicon, the mobile support member configured to selectively interpose in the propagation path of the light beam between the negative lens and the further negative lens an optical element selected out of said at least two different optical elements.

2. The lighting device of claim 1, wherein the mobile support member comprises a motorized effect wheel.

3. The lighting device of claim 1, wherein the negative lens comprises a simple negative lens.

4. The lighting device of claim 1, wherein the positive lens comprises an achromatic doublet.

5. The lighting device of claim 1, wherein one of the at least two different optical elements comprises the prism, and the prism includes a pyramidal prism.

6. The lighting device of claim 5, wherein, when the pyramidal prism is selectively interposed in the propagation path of the light beam between the negative lens and the further negative lens, a tapered side of the pyramidal prism is facing towards the positive lens.

7. The lighting device of claim 1, wherein one of the at least two different optical elements comprises the axicon, and when the axicon is selectively interposed in the propagation path of the light beam between the negative lens and the further negative lens, a tapered side of the axicon is facing towards the positive lens.

8. A method of operating a lighting device according to claim 1, the method comprising moving the further negative lens along the propagation path of the light beam:

bringing it closer to the negative lens and away from the positive lens, or moving it away from the negative lens and bringing it closer to the positive lens.

9. The method of claim 8, comprising selectively changing the optical element interposed in the propagation path of the light beam.

* * * * *